United States Patent [19]

Jacobs

[11] 4,052,635

[45] Oct. 4, 1977

[54] ELECTRIC DISCHARGE LAMP

[75] Inventor: Cornelis Adrianus Joannes Jacobs, Eindhoven, Netherlands

[73] Assignee: U.S. Philips Corporation, New York, N.Y.

[21] Appl. No.: 727,035

[22] Filed: Sept. 27, 1976

[30] Foreign Application Priority Data

Sept. 29, 1975 Netherlands ..... 7511416

[51] Int. Cl.[2] ..... H01J 61/06

[52] U.S. Cl. ..... 313/217; 313/331

[58] Field of Search ..... 313/217, 331

[56] References Cited

U.S. PATENT DOCUMENTS 3,855,495 12/1974 Pappas et al. ..... 313/331 X

*Primary Examiner*—Rudolph V. Rolinec

*Assistant Examiner*—Darwin R. Hostetter

*Attorney, Agent, or Firm*—Frank R. Trifari; Robert S. Smith

[57] ABSTRACT

Electric discharge lamps having a ceramic lamp vessel and current leadthroughs of niobium or tantalum cannot be operated in a nitrogen-containing atmosphere or in air due to attack of the current leadthroughs by the surrounding gas.

According to the invention, those parts of the current leadthroughs which during operation have a temperature of more than 500° C and more than 350° C, respectively, are screened from the surrounding gas by means of ceramic mouldings which are connected to the current leadthrough in a gas-tight manner by means of sealing material. As a result of this the lamps according to the invention can be operated in a nitrogen-containing atmosphere and in air respectively.

4 Claims, 5 Drawing Figures

ELECTRIC DISCHARGE LAMP

Figure 1:
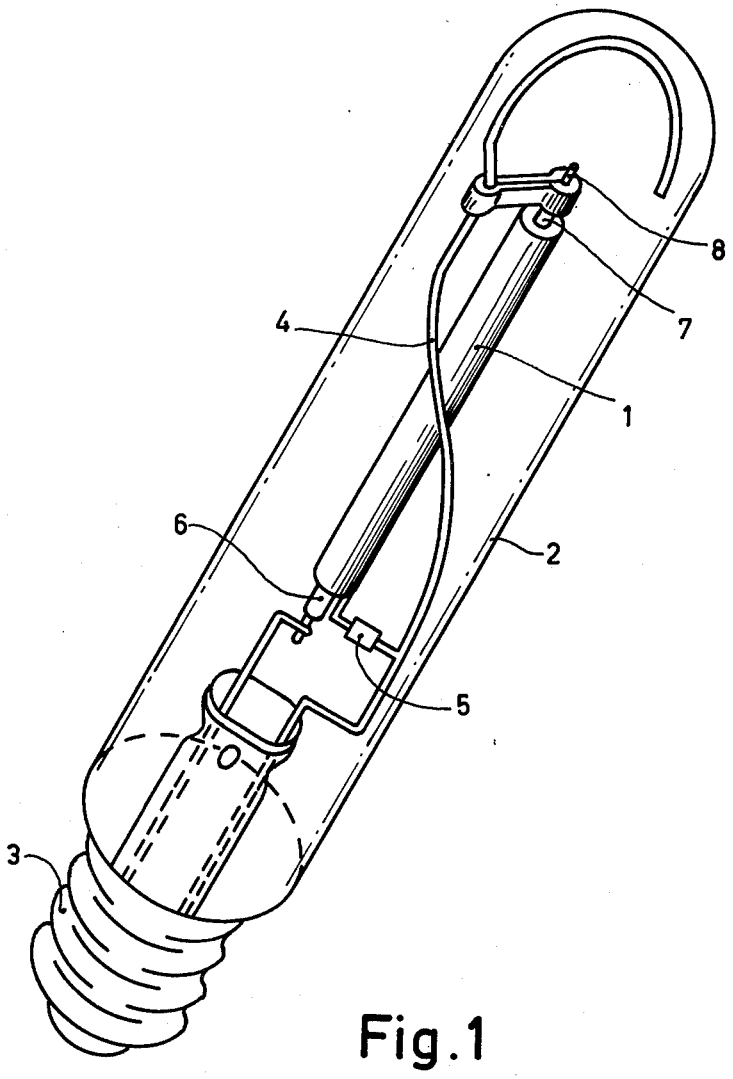

The invention relates to an electric discharge lamp having a ceramic lamp vessel in the wall of which are incorporated cylindrical current lead-throughs of niobium of tantalum which are connected at one end to the electrodes and project beyond the lamp vessel at the other end, means being present to protect the current leadthroughs against attack by gas surrounding the lamp vessel.

In discharge lamps having a high operating temperature, for example 1000° C or higher, the lamp vessel consists of ceramic material, which is to be understood to mean herein both polycrystalline material, such as transparent, gas-tight aluminium oxide, spinel ($MgAl_2O_4$) and yttrium oxide, and monocrystalline material, such as sapphire.

The current leadthroughs which are incorporated in the wall of a ceramic lamp vessel to supply current to the electrodes usually consist of niobium or tantalum since these metals, as regards their coefficients of thermal expansion, correspond best to ceramic. However, at higher temperatures these metals cannot withstand nitrogen and oxygen: with nitrogen, metal nitrides are formed which are brittle and are readily permeable to nitrogen, so that nitrogen diffuses into the lamp vessel as a result of which the ignition voltage of the lamp is increased; with oxygen, metal oxides are formed, which results in a mechanical weakening of the lamp construction so that leakage of gas occurs which induces the end of the life.

Consequently, lamps having niobium or tantalum current leadthroughs should be operated in an evacuated or rare gas-filled outer envelope. However, there exists a need of operating the lamps in a nitrogen-containing gas atmosphere or in air.

German Offenlegungsschrift No. 2,410,123 discloses a lamp of the kind mentioned in the preamble in which a ceramic housing is provided around the part of a cylindrical current leadthrough of niobium or tantalum projecting beyond the lamp vessel which housing is connected to the wall of the lamp vessel in a gas-tight manner. The current supply to the lamp is realized by a platinum foil which is connected to the current leadthrough and is lead through in a gas-tight manner between the wall of the lamp vessel and the ceramic housing.

Although this construction enables the lamps to be operated in air, it is complicated, expensive and vulnerable.

It is an object of the invention to provide simpler means to protect niobium and tantalum current leadthroughs against attack by the gas surrounding the discharge vessel.

In agreement herewith the invention relates to an electric discharge lamp of the kind mentioned in the preamble which is characterized in that the parts of the current leadthroughs which during operation have a temperature of more than 500° C are screened from the gas surrounding the lamp vessel by means of ceramic mouldings which are connected in a gas-tight manner to the current lead-throughs by means of sealing material.

It has been found that such a lamp can be operated in nitrogen or in nitrogen-containing gas mixtures without the nitrogen attacking the metal of the current leadthroughs.

In a preferred embodiment of the lamp according to the invention the lamp is also suitable to be operated in air. The advantage of such a lamp is that the lamp vessel and not be surrounded by an outer envelope so that luminaires in which the lamp is accommodated may be smaller. The lamp of this preferred embodiment is characterized in that the parts of the current lead-throughs which during operation have a temperature of more than 350° C are screened from the gas surrounding the lamp vessel by means of ceramic mouldings which are connected to the current leadthroughs in a gas-tight manner by means of sealing material.

In lamps having current leadthroughs which are closed at the end projecting from the lamp vessel-solid cylinders and hollow cylinders which are sealed at their ends, for example by flattening, welding or soldering-the protective ceramic mouldings may consist of cylindrical sleeves which are provided around the leadthroughs and are connected thereto and to the wall of the lamp envelope at the area of the leadthrough by means of sealing material.

The inside diameter of the sleeves is preferably chosen to be so that a capillary space which can be filled by the sealing material is obtained between the sleeve and the current leadthrough.

The wall thickness of the sleeves is little critical. As a rule it will not be chosen to be smaller than 0.4 mm. Economical considerations only determine the largest wall thickness, although as a rule it will not be chosen to be so large that the sleeves have a larger outside diameter than the lamp vessel. Sleeves having a wall thickness of at least 1 mm are preferably used.

If in a lamp having a cylindrical lamp vessel a current leadthrough is incorporated in a wall part with which the lamp vessel is sealed at its ends, which is the case in most of the lamps, the ceramic sleeve may form one unit with said wall part.

For each lamp type it can easily be determined in a single experiment what length the ceramic sleeves should have in order that bare external parts of the current leadthrough members have a temperature of at most 500 and 350° C, respectively.

Due to the fact that the coefficients of expansion of ceramic on the one hand and niobium and tantalum on the other hand are not quite the same, hollow, cylindrical current leadthroughs will preferably be used, notably when current leadthroughs of larger diameters (for example larger than 1mm) are used.

In hollow cylindrical current leadthroughs which are open at the end projecting from the lamp vessel, according to the invention a cylindrical ceramic moulding is provided in the leadthrough in addition to a ceramic sleeve around the current leadthrough, and is connected thereto in a gas-tight manner by mens of sealing material.

The diameter of said moulding is preferably chosen to be so that a capillary space which can be filled with sealing material is formed between the moulding and the current leadthrough.

The length of the cylindrical moulding is not very critical. As a rule, the moulding will at least be chosen to be so long that, after insertion in the current leadthrough, it cannot tilt therein and that a gas-tight seal is ensured. As a rule, a length of 3mm will amply suffice although there is no objection to using longer mouldings.

High-melting-point sealing materials are described inter alia in the U.S. Pat. Nos. 3,281,309, 3,441,421 and 3,588,577 and in German Offenlegungsschrift 1,471,379.

As compared with the lamp construction known from German Offenlegungsschrift No. 2,410,123, the construction according to the invention is considerably simpler, cheaper and mechanically more rigid. In lamps according to the invention, a current supply can simply be connected to the uncovered end of a current leadthrough. Lamps which are not operated in an outer envelope can be contacted directly with the uncovered parts of the current leadthroughs to the connection points of luminaires.

Figure 2:
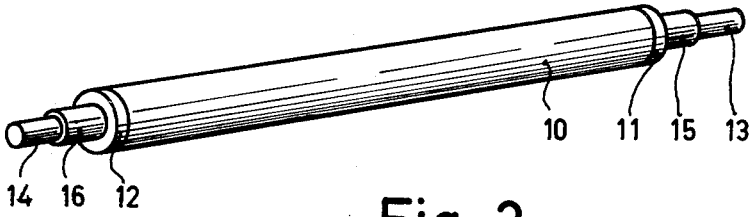
Figure 3:
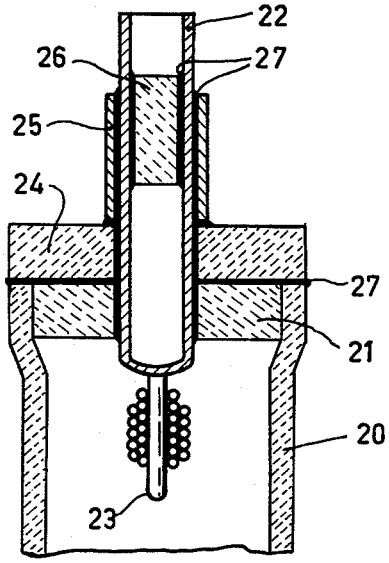
Figure 4:
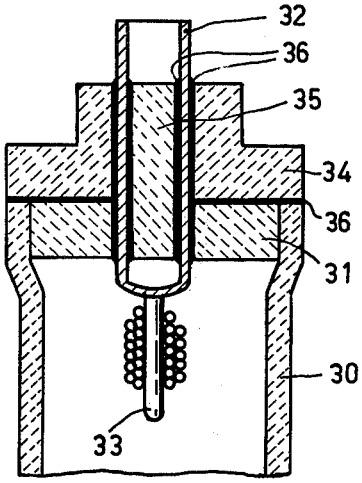
Figure 5:
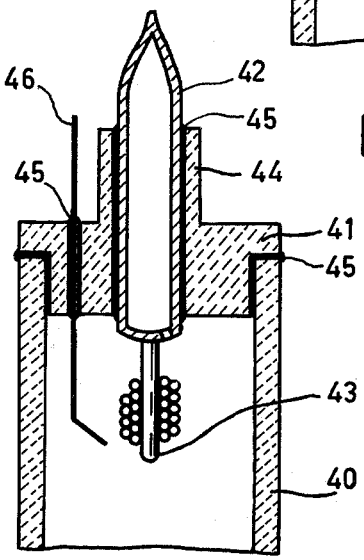

The invention will now be described in greater detail with reference to the accompanying drawings, in which FIG. 1 is an elevation of a high-pressure sodium lamp, FIG. 2 shows a high-pressure sodium lamp which can be operated in air, FIGS. 3 to 5 are longitudinal sectional views through a part of a lamp vessel.

Reference numeral 1 in FIG. 1 denotes the ceramic lamp vessel of a 220V/250W high-pressure sodium lamp which is mounted in a nitrogen-filled outer envelope 2 which has a lamp cap 3. A pole wire 4 supplies current via the bare part 8 of a current leadthrough to one of the electrodes and also via resistor 5 to an auxiliary electrode 6 and 7 denote ceramic sleeves which screen the parts of the current leadthroughs which during operation have a temperature of more than 500° C.

In FIG. 2, the ceramic lamp vessel 10 of a 220V/250W high-pressure sodium lamp is sealed at the ends by ceramic mouldings 11 and 12 through which hollow current leadthroughs 13 and 14 of niobium are passed the parts of which, which during operation have a temperature of over 350° C, are protected with ceramic sleeves 15 and 16 (ceramic cylinders in the current leadthroughs are not visible in the drawing). The lamp may be operated in air. The bare parts 13 and 14 serve for the connection to the current supply and assembly of the lamp in a luminaire.

In FIG. 3 a cylindrical tube 20 of transparent gas-tight aluminium oxide is connected, by means of a shrinkage sintering operation, to a disc 21 of transparent gas-tight aluminium oxide. A cylindrical niobium sleeve 22 to which a tungsten electrode 23 is soldered by means of titanium, is provided in the central aperture of disc 21. A second disc 24 of transparent gas-tight aluminium oxide is laid over the sintered joint of tube 20 and disc 21. The object of said disc is to prevent leakage of gas via a possibly imperfect sintered joint seam between wall 20 and disc 21. The sleeve 22 is partly surrounded by a cylindrical sleeve 25 of transparent gas-tight aluminium oxide, while a transparent gas-tight aluminium oxide cylinder 26 is provided in the sleeve 22. The various parts are connected together in a gas-tight manner by means of sealing material 27.

FIG. 4 shows a modified embodiment in which a transparent gas-tight aluminium oxide tube 30 is connected to a transparent gas-tight aluminium oxide disc 31 by sintering and in which a cylindrical tantalum sleeve 32 having a tungsten electrode 33 is surrounded by a ceramic moulding 34 which combines the functions of ring 24 and sleeve 25 of FIG. 3. A transparent gas-tight aluminium oxide cylinder 35 is present in the sleeve 32. The various parts are connected together by means of sealing material.

FIG. 5 shows a cylindrical lamp vessel of transparent gas-tight aluminium oxide sealed by a ceramic moulding 41 which forms one assembly with the sleeve 44. A niobium sleeve 42 which is squeezed at the outer end and supports the electrode 43 is present in the central aperture of the moulding. A 60 μm thick tungsten wire 46 as an auxiliary electrode is introduced through a bore in the mounding 41 into the lamp vessel. All the parts are connected by means of sealing material 45.

EXAMPLE I

A cylindrical tube 20 (FIG. 3) of transparent gas-tight aluminium oxide having an outside diameter of 8.6 mm and an inside diameter of 6.8 mm is partly closed at both ends by 3mm thick discs 21 of transparent gas-tight aluminium oxide having a bore of 4.1 mm. The sealing was realized by heating the combined parts at 1850° C in a hydrogen atmosphere.

A niobium tube 22 of 4.0 mm outside diameter and a wall thickness of 250 μm having a tungsten electrode 23 was then passed through the aperture of disc 21. The disc 24 having a thickness of 1 mm and sleeve 25 having a wall thickness of 2 mm inside diameter 4.1 mm, length 10 mm both of transparent gas-tight aluminium oxide where then provided around the tube. A transparent gas-tight aluminium oxide cylinder 26 having a diameter of 3.4 mm and a length of 3 mm was provided in the niobium tube. Near the slots to be sealed, sealing materials was provided: 44% by weight of $Al_2O_3$ 38% by weight of CaO, 9% by weight of BaO, 6% by weight of MgO, 2% by weight of $B_2O_3$ and 1% by weight of $SiO_2$, after which heating in a vacuum was carried out up to 1450° C.

The unilaterally closed lamp vessel was flushed with xenon, provided with 20 mg of sodium amalgam (sodium content 18% by weight) and then sealed in an identical manner at the other end in an atmosphere of 40 Torr xenon, while cooling the first sealed end.

The lamp of which the tungsten electrodes had a mutal spacing of 64 mm and were provided with a barium calcium tungstanate emitter consumed 250 Watt at 220 V.

The lamp was operated without an outer envelope.

EXAMPLE II

A 220V/400W high-pressure sodium lamp, inside diameter 7.4 mm, outside diameter 9.0 mm, a disc 24, 1 mm thick, a disc 21, 2 mm thick, a sleeve 25, 3 mm long, wall thickness 1 mm, and an electrode spacing of 83 mm was assembled in a manner analogous to that of the lamp of example I. The lamp was operated in a nitrogen-filled outer envelope.

What is claimed is:

1. An electric discharge lamp having a ceramic lamp vessel in the wall of which are incorporated cylindrical current leadthroughs of niobium or tantalum which are connected at one end to the electrodes and project at the other beyond the lamp vessel, means being present to protect the leadthroughs against attack by gas surrounding the lamp vessel, wherein the parts of the current leadthroughs which during operation have a temperature of more than 500° C are screened from the gas surrounding the lamp vessel by means of ceramic mouldings which are connected in a gas-tight manner to the current leadthroughs by means of sealing material.

2. An electric discharge lamp as claimed in claim 1, wherein the parts of the current leadthroughs which during operation have a temperature of more than 350°

C are screened from the gas surrounding the lamp vessel by means of ceramic mouldings which are connected to the current leathroughs in a gas-tight manner by means of sealing material.

3. An electric discharge lamp as claimed in claim 1 wherein said current leadthroughs are hollow for at least a portion of the extent thereof.

4. An electric discharge lamp as claimed in claim 1 wherein said lamp vessel cylindrical and said ceramic sleeves form one unit with end seals of said lamp vessel.

* * * * *